US012297725B2

(12) United States Patent
Bunger et al.

(10) Patent No.: US 12,297,725 B2
(45) Date of Patent: May 13, 2025

(54) CONTROL OF FRACTURE GROWTH DURING WELL OPERATION

(71) Applicants: Chevron U.S.A. Inc., San Ramon, CA (US); University of Pittsburgh—Of the Commonwealth System of Higher Education, Pittsburgh, PA (US)

(72) Inventors: Andrew Paul Bunger, Pittsburgh, PA (US); Amr Said El-Fayoumi, Houston, TX (US); Jose I. Adachi, Houston, TX (US); Karim S. Zaki, Houston, TX (US); Qiao Lu, Pittsburgh, PA (US)

(73) Assignees: Chevron U.S.A. Inc., San Ramon, CA (US); University of Pittsburgh—Of the Commonwealth System of Higher Education, Pittsburgh, PA (US)

( * ) Notice: Subject to any disclaimer, the term of this patent is extended or adjusted under 35 U.S.C. 154(b) by 414 days.

(21) Appl. No.: 17/734,713

(22) Filed: May 2, 2022

(65) Prior Publication Data

US 2022/0364449 A1 Nov. 17, 2022

Related U.S. Application Data

(60) Provisional application No. 63/186,764, filed on May 10, 2021.

(51) Int. Cl.
*E21B 43/26* (2006.01)
*E21B 47/06* (2012.01)

(52) U.S. Cl.
CPC ..... *E21B 43/26* (2013.01); *E21B 47/06* (2013.01)

(58) Field of Classification Search
CPC ..... E21B 43/26; E21B 47/06
See application file for complete search history.

(56) References Cited

U.S. PATENT DOCUMENTS 6,876,959 B1 * 4/2005 Peirce ..... E21B 43/267 702/14
9,222,337 B2 12/2015 Bunger
10,422,208 B2 * 9/2019 Weng ..... E21B 43/267
(Continued)

FOREIGN PATENT DOCUMENTS

CA 3022739 A1 * 5/2019 ..... E21B 43/127
CA 3097884 A1 * 3/2022 ..... E21B 43/267
(Continued)

OTHER PUBLICATIONS

Adachi et al. "Analysis oftheclassicalpseudo-3Dmodelforhydraulicfracturewith equilibrium height growth across stress barriers" (Year: 2010).*
(Continued)

*Primary Examiner* — Eyob Hagos
(74) *Attorney, Agent, or Firm* — Esplin & Associates, PC

(57) ABSTRACT

A dissipation equilibrium value for a well operation may be determined based on a height of a fracture within a layer and a limit on the change of the height of the fracture (fracture height change limit). A pressure limit for the well operation may be determined based on the dissipation equilibrium value, stress in the layer, and stress in a bounding layer. The pressure limit may be used to control the pressure of the well during the well operation, and prevent growth of the fracture beyond the fracture height change limit.

21 Claims, 5 Drawing Sheets

(56) References Cited

U.S. PATENT DOCUMENTS

| | | | | |
|---|---|---|---|---|
| 2003/0051873 | A1 | 3/2003 | Patzek | |
| 2006/0224370 | A1* | 10/2006 | Siebrits | E21B 43/26 703/10 |
| 2008/0209997 | A1 | 9/2008 | Bailey | |
| 2009/0145599 | A1* | 6/2009 | Siebrits | G06F 30/28 703/2 |
| 2011/0247824 | A1* | 10/2011 | Gu | E21B 43/26 166/308.1 |
| 2012/0325462 | A1* | 12/2012 | Roussel | G01V 1/306 166/250.1 |
| 2015/0039234 | A1* | 2/2015 | Abou-Sayed | G01V 99/00 702/11 |
| 2016/0370499 | A1* | 12/2016 | Berard | G01V 99/00 |
| 2017/0096886 | A1 | 4/2017 | Chuprakov | |
| 2017/0145793 | A1* | 5/2017 | Ouenes | G06F 17/18 |
| 2019/0112909 | A1* | 4/2019 | Zeng | E21B 43/26 |
| 2021/0079788 | A1* | 3/2021 | Wang | E21B 49/008 |

FOREIGN PATENT DOCUMENTS

| | | | | |
|---|---|---|---|---|
| CN | 108829994 | | 11/2018 | |
| CN | 114444340 | A * | 5/2022 | E21B 43/247 |
| CN | 115126459 | A * | 9/2022 | E21B 43/26 |
| WO | WO-2015069817 | A1 * | 5/2015 | E21B 43/26 |

OTHER PUBLICATIONS

Liu et al. "A Rigorous Hydraulic-Fracture Equilibrium-Height Model for Multilayer Formations" (Year: 2017).*

Bunger, A. P. (2013). Analysis of the power input needed to propagate multiple hydraulic fractures. International Journal of Solids and Structures, 50(10), 1538-1549.

Fu, W., Savitski, A. A., & Bunger, A. P. (2018). Analytical criterion predicting the impact of natural fracture strength, height and cemented portion on hydraulic fracture growth. Engineering Fracture Mechanics, 204, 497-516.

Nordgren, R. P. (1972). Propagation of a vertical hydraulic fracture. Society of Petroleum Engineers Journal, 12(04), 306-314.

Simonson, E. R., Abou-Sayed, A. S., & Clifton, R. J. (1978). Containment of massive hydraulic fractures. Society of Petroleum Engineers Journal, 18(01), 27-32.

Tada, H., Paris, P. C., Irwin, G. R., & Tada, H. (2000). The stress analysis of cracks handbook (vol. 130). New York: ASME press.

Lu Q, El-Fayoumi A, Adachi J, Zaki K, Bunger AP. 2023. Laboratory Demonstration of the Impact of Weak Interfaces and Layered Rock Properties on Hydraulic Fracture Containment and Height Growth. Geomechanics and Geophysics for Geo-Energy and Geo-Resources, 9, 113.

Dontsov, E. V., & Peirce, A. P. (2015). An enhanced pseudo-3D model for hydraulic fracturing accounting for viscous height growth, non-local elasticity, and lateral toughness. Engineering Fracture Mechanics, 142, 116-139.

Jeffrey, R. G., & Bunger, A. (2009). A detailed comparison of experimental and numerical data on hydraulic fracture height growth through stress contrasts. Spe Journal, 14(03), 413-422.

* cited by examiner

CONTROL OF FRACTURE GROWTH DURING WELL OPERATION

CROSS-REFERENCE TO RELATED APPLICATION

The present application claims the benefit of U.S. Provisional Application No. 63/186,764, entitled "CONTROL OF FRACTURE GROWTH DURING WELL OPERATION," which was filed on May 10, 2021, the entirety of which is hereby incorporated herein by reference.

FIELD

The present disclosure relates generally to the field of controlling fracture growth during operation of a well via usage of a dissipation equilibrium value to control pressure of the well.

BACKGROUND

Pressure within a well may cause a fracture within a layer to grow. Pressure may be reduced to reduce the amount of fracture growth. However, reducing pressure within the well may decrease the productivity of the well, such as for recovery of hydrocarbons.

SUMMARY

This disclosure relates to controlling fracture growth during operation of a well. Fracture information, fracture limit information, layer stress information, bounding layer stress information, and/or other information may be obtained. Fracture information for a layer may characterize a height of a fracture within the layer. The fracture limit information may characterize a limit on change of the height of the fracture during a well operation. The layer stress information may characterize stress in the layer. The bounding layer stress information for a bounding layer above the layer may characterize stress in the bounding layer. A dissipation equilibrium value for the well operation may be determined based on the height of the fracture, the limit on change of the height of the fracture during the well operation, and/or other information. A pressure limit for the well operation may be determined based on the dissipation equilibrium value, the stress in the layer, the stress in the bounding layer, and/or other information. Use of the pressure limit to control pressure of the well during the well operation may be facilitated.

A system for controlling fracture growth during operation of a well may include one or more electronic storage, one or more processors and/or other components. The electronic storage may store fracture information, information relating to a layer, information relating to a fracture within a layer, information relating to a height of a fracture within a layer, fracture limit information, information relating to a limit on change of a height of a fracture, information relating to a well operation, layer stress information, information relating to stress in a layer, bounding layer stress information, information relating to stress inn a bounding layer, information relating to dissipation equilibrium value, information relating to dissipation equilibrium line, information relating to pressure limit, information relating to control of pressure of a well, and/or other information.

The processor(s) may be configured by machine-readable instructions. Executing the machine-readable instructions may cause the processor(s) to facilitate controlling fracture growth during operation of a well. The machine-readable instructions may include one or more computer program components. The computer program components may include one or more of a fracture component, a fracture limit component, a layer stress component, a bounding layer stress component, a dissipation component, a pressure limit component, a control component, and/or other computer program components.

The fracture component may be configured to obtain fracture information for a layer and/or other information. The fracture information for the layer may characterize a height of a fracture within the layer.

The fracture limit component may be configured to obtain fracture limit information for the fracture and/or other information. The fracture limit information for the fracture may characterize a limit on change of the height of the fracture during a well operation.

In some implementations, the limit on change of the height of the fracture during the well operation may include a maximum amount by which the height of the fracture is allowed to be changed during the well operation. In some implementations, the well operation may include fluid injection.

The layer stress component may be configured to obtain layer stress information for the layer and/or other information. The layer stress information for the layer may characterize stress in the layer.

The bounding layer stress component may be configured to obtain bounding layer stress information for a bounding layer and/or other information. The bounding layer may be above the layer. The bounding layer stress information for the bounding layer may characterize stress in the bounding layer.

The dissipation component may be configured to determine a dissipation equilibrium value for the well operation. The dissipation equilibrium value for the well operation may be determined based on the height of the fracture, the limit on change of the height of the fracture during the well operation, and/or other information. In some implementations, the dissipation equilibrium value may be determined based on a ratio of the limit on change of the height of the fracture during the well operation to the height of the fracture.

In some implementations, the dissipation equilibrium value may be a point on a dissipation equilibrium line. The point on the dissipation equilibrium line may be associated with the limit on change of the height of the fracture during the well operation and the pressure limit for the well operation. In some implementations, the dissipation equilibrium line may separate pressure values resulting in a negative change in dissipation rate of fluid flow from pressure values resulting in a positive change in dissipation rate of fluid flow.

In some implementations, the dissipation equilibrium value for the well operation may be determined based on the height of the fracture and the limit on change of the height of the fracture during the well operation responsive to a non-slipping interface existing between the layer and the bounding layer, and the limit on change of the height of the fracture during the well operation being less than the height of the fracture.

In some implementations, the dissipation equilibrium value for the well operation may be determined as one responsive to a slipping interface existing between the layer and the bounding layer.

In some implementations, the dissipation equilibrium value for the well operation may be determined as one responsive to the non-slipping interface existing between the layer and the boundary layer, and the limit on change of the height of the fracture during the well operation being greater than the height of the fracture.

The pressure limit component may be configured to determine a pressure limit for the well operation. The pressure limit for the well operation may be determined based on the dissipation equilibrium value, the stress in the layer, the stress in the bounding layer, and/or other information. In some implementations, the pressure limit may include an injection pressure limit.

The control component may be configured to facilitate use of the pressure limit. The pressure limit may be used to control pressure of the well during the well operation. In some implementations, the injection pressure limit may be used to control injection pressure of the well during the fluid injection. In some implementations, the injection pressure of the well may be controlled such that the injection pressure of the well does not rise above the injection pressure limit.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

DETAILED DESCRIPTION

The present disclosure relates to controlling fracture growth during operation of a well. A dissipation equilibrium value for a well operation may be determined based on a height of a fracture within a layer and a limit on the change of the height of the fracture (fracture height change limit). A pressure limit for the well operation may be determined based on the dissipation equilibrium value, stress in the layer, and stress in a bounding layer. The pressure limit may be used to control the pressure of the well during the well operation, and prevent growth of the fracture beyond the fracture height change limit.

Figure 1:
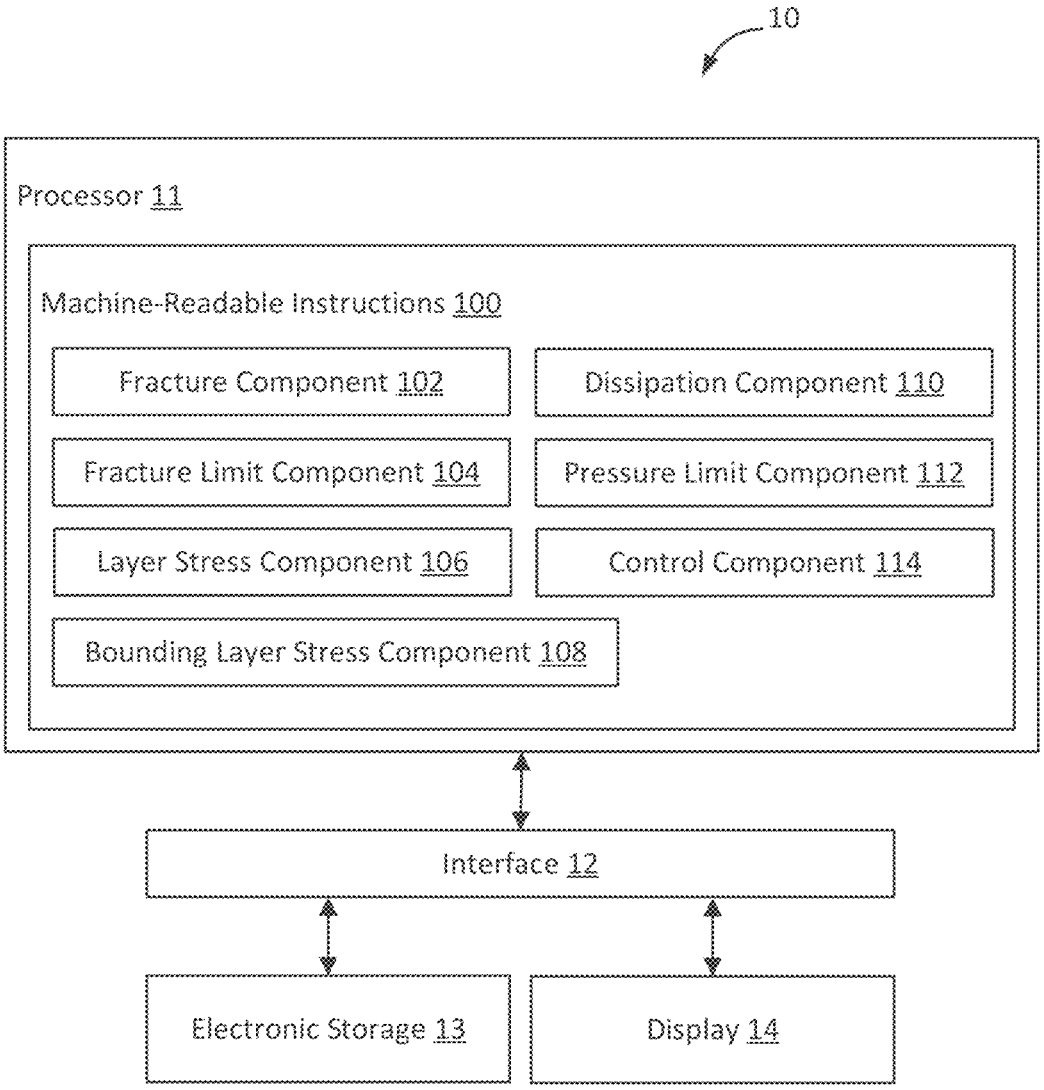
FIG. 1 illustrates an example system for controlling fracture growth during operation of a well.

The methods and systems of the present disclosure may be implemented by a system and/or in a system, such as a system 10 shown in FIG. 1. The system 10 may include one or more of a processor 11, an interface 12 (e.g., bus, wireless interface), an electronic storage 13, a display 14, and/or other components. Fracture information, fracture limit information, layer stress information, bounding layer stress information, and/or other information may be obtained by the processor 11. Fracture information for a layer may characterize a height of a fracture within the layer. The fracture limit information may characterize a limit on change of the height of the fracture during a well operation. The layer stress information may characterize stress in the layer. The bounding layer stress information for a bounding layer above the layer may characterize stress in the bounding layer. A dissipation equilibrium value for the well operation may be determined by the processor 11 based on the height of the fracture, the limit on change of the height of the fracture during the well operation, and/or other information. A pressure limit for the well operation may be determined by the processor 11 based on the dissipation equilibrium value, the stress in the layer, the stress in the bounding layer, and/or other information. Use of the pressure limit to control pressure of the well during the well operation may be facilitated by the processor 11.

The electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store fracture information, information relating to a layer, information relating to a fracture within a layer, information relating to a height of a fracture within a layer, fracture limit information, information relating to a limit on change of a height of a fracture, information relating to a well operation, layer stress information, information relating to stress in a layer, bounding layer stress information, information relating to stress in a bounding layer, information relating to dissipation equilibrium value, information relating to dissipation equilibrium line, information relating to pressure limit, information relating to control of pressure of a well, and/or other information.

The display 14 may refer to an electronic device that provides visual presentation of information. The display 14 may include a color display and/or a non-color display. The display 14 may be configured to visually present information. The display 14 may present information using/within one or more graphical user interfaces. For example, the display 14 may present information relating to fractures, fracture heights, fracture height limits, stresses, layers, dissipation equilibrium values, dissipation equilibrium lines, pressure limits, and/or other information. For instance, the display 14 may present pressure limit to be used in well operation to prevent excess fracture height growth.

A fracture may refer to separation in a geologic formation, such as within a subsurface layer. For example, a fracture may refer to a crack or a breakage within rock. A fracture may provide permeability for fluid movement, such as for water or hydrocarbons. A fracture may be used to increase recovery of hydrocarbons buried underground. For example, an injection well may be located near one or more production wells. Hydrocarbon production in the production well(s) may be increased through fluid injection at the injection well. The fluid injection in the injection well may be used to maintain pressure in the reservoir and promote recovery of hydrocarbons through the production well(s).

However, fluid injection may cause the fracture to grow. Pressure caused by the fluid injection may cause the fracture to grow both laterally and vertically. Greater pressure, while increasing hydrocarbon production, may result in greater growth of the fracture. It may be desirable to control the growth of fracture during fluid injection. For example, a target/reservoir layer may be below an area into which fracture growth is not desirable. It may be desirable to control the growth of fracture during fluid injection such that the fracture does not grow vertically to penetrate/open into such an area. However, reducing pressure during fluid injection to prevent vertical growth of the fracture may reduce the effectiveness of the injection well in promoting hydrocarbon recovery at the production wells.

A well may refer to a hole or a tunnel in the ground. A well may be drilled in one or more directions. For example, a well may include a vertical well, a horizontal well, a deviated well, and/or other type of well. A well may be drilled in the ground for exploration and/or recovery of natural resources in the ground. For example, a well may be drilled in the ground to aid in extraction and/or production of hydrocarbons. As another example, a well may be drilled in the ground for fluid injection. Application of the present disclosure to other types of wells and wells drilled for other purposes are contemplated.

A well may be drilled into a subsurface region using practically any drilling technique and equipment known in the art, such as geosteering, directional drilling, etc. Drilling a wellbore may include using a tool, such as a drilling tool that includes a drill bit and a drill string. Drilling fluid, such as drilling mud, may be used while drilling in order to cool the drill tool and remove cuttings. Other tools may also be used while drilling or after drilling, such as measurement-while-drilling (MWD) tools, seismic-while-drilling (SWD) tools, wireline tools, logging-while-drilling (LWD) tools, and/or other downhole tools. After drilling to a predetermined depth, the drill string and the drill bit may be removed, and then the casing, the tubing, and/or other equipment may be installed according to the design of the well. The equipment to be used in drilling a well may be dependent on the design of the well, the subsurface region, the hydrocarbons, and/or other factors.

A well may include a plurality of components, such as, but not limited to, a casing, a tubing strong, a liner, a sensor, a packer, a screen, a gravel pack, artificial lift equipment (e.g., an electric submersible pump (ESP)), and/or other components. If a wellbore is drilled offshore, the wellbore may include one or more of the previous components plus other offshore components, such as a riser. A wellbore may also include equipment to control fluid flow into the wellbore, control fluid flow out of the wellbore, or any combination thereof. For example, a well may include a wellhead, a choke, a valve, and/or other control devices. These control devices may be located on the surface, under the surface (e.g., downhole in the well), or any combination thereof. In some implementations, same control devices may be used to control fluid flow into and out of a well. In some implementations, different control devices may be used to control fluid flow into and out of a well. In some implementations, the rate of flow of fluids through a well may depend on the fluid handling capacities of the surface facility that is in fluidic communication with the well. The equipment to be used in controlling fluid flow into and out of a well may be dependent on the well, the subsurface region, the surface facility, and/or other factors. Moreover, sand control equipment and/or sand monitoring equipment may also be installed (e.g., downhole and/or on the surface). A well may also include any completion hardware that is not discussed separately. The term "well" may be used synonymously with the terms "borehole," "wellbore," or "well bore." The term "well" or "wellbore" is not limited to any description or configuration described herein.

Figure 3:
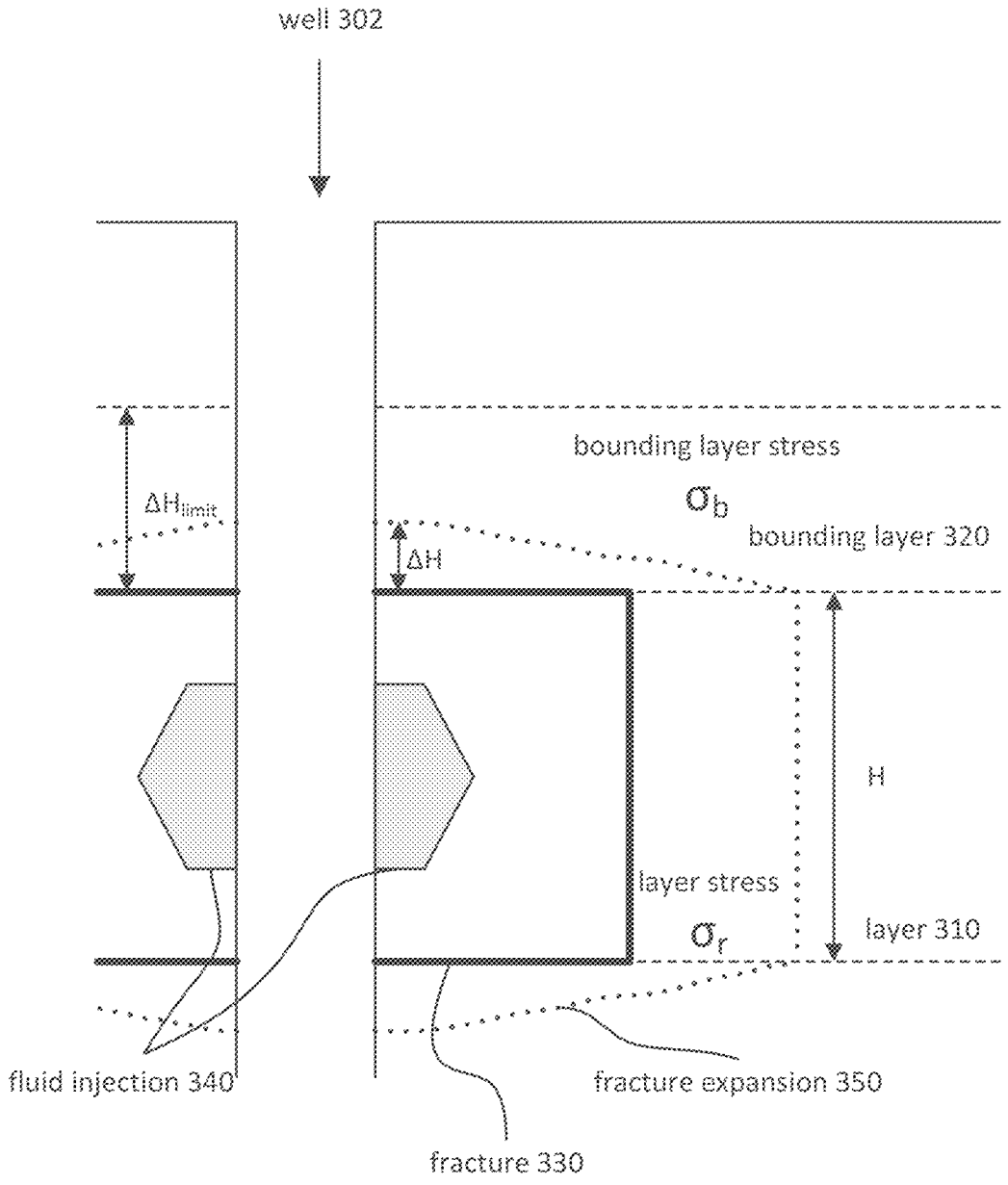
FIG. 3 illustrates an example well.

FIG. 3 illustrates an example well 302. The well 302 may be a vertical well. The well 302 may penetrate through multiple layers under the ground (subsurface layers). For example, the well 302 may penetrate through a layer 310, a bounding layer 320, and/or other layers. The bounding layer 320 may be above the layer 310. The horizontal stress in the layer 310 may be referred to as layer stress ($\sigma_r$). The horizontal stress in the bounding layer may be referred to as bounding layer stress ($\sigma_b$). The values of stresses in the layers may be dependent on the properties of materials within the layers (e.g., rock properties).

The layer 310 may include one or more fractures, such as a fracture 330. The fracture 330 may be the primary fracture of the layer 310. For example, the fracture 330 may be the primary fracture used in waterflooding to displace/sweep oil and/or used to increase/maintain pressure in the layer 310. The fracture 330 may have a height H (measured from bottom of the fracture 330 to the top of the fracture 330). The height H of the fracture 330 may be equal to the height of the layer 310.

Fluid injection 340 may increase/maintain pressure in the layer 310/the fracture 330, which may cause the fracture 330 to grow like an envelope in the layer 310. The fracture 330 may grow laterally and vertically. The growth of the fracture 330 due to fluid injection 340 is shown in FIG. 3 as fracture expansion 350. For example, the fracture 330 may grow vertically by a certain amount $\Delta H$ and grow laterally by a certain amount. While the fracture expansion 350 is shown as being vertically and horizontally symmetrical in FIG. 3, this is merely as an example and is not meant to be limiting. In some implementations, the fracture expansion may not be symmetrical.

The maximum amount by which the fracture 330 is allowed to grow vertically during a well operation (e.g., desired maximum vertical growth limit) may be shown as $\Delta H_{limit}$. The maximum amount by which the fracture 330 is allowed to grow vertically may include a distance between the top of the fracture 330 to the top of the bounding layer 320. For example, an area may exist above the bounding layer 320 and it may be desirable to prevent the fracture 330 from growing out of the bounding layer 320. As another example, growing the fracture into a non-hydrocarbon bearing layer may result in waste of energy/fluid during fluid injection, which may reduce efficiency of the well 302. Controlling the growth of the fracture 330 so that it does not grow in height more than $\Delta H_{limit}$ may result in the fracture 330 being contained within the bounding layer 320.

The bounding layer stress ($\sigma_b$) may be greater than the layer stress ($\sigma_r$), and this greater bounding layer stress ($\sigma_r$) may be used to prevent the fracture expansion 350 from growing above the bounding layer 320. That is, the higher value of the bounding layer stress ($\sigma_b$) may be used to limit vertical propagation of the fracture 330 beyond the bounding layer 320. The higher value of the bounding layer stress ($\sigma_b$) may make it energetically more advantageous for the fracture to growth laterally than vertically. The bounding layer 320 may operate as a barrier layer in containing the fracture expansion 350 during the fluid injection 340.

Figure 4:
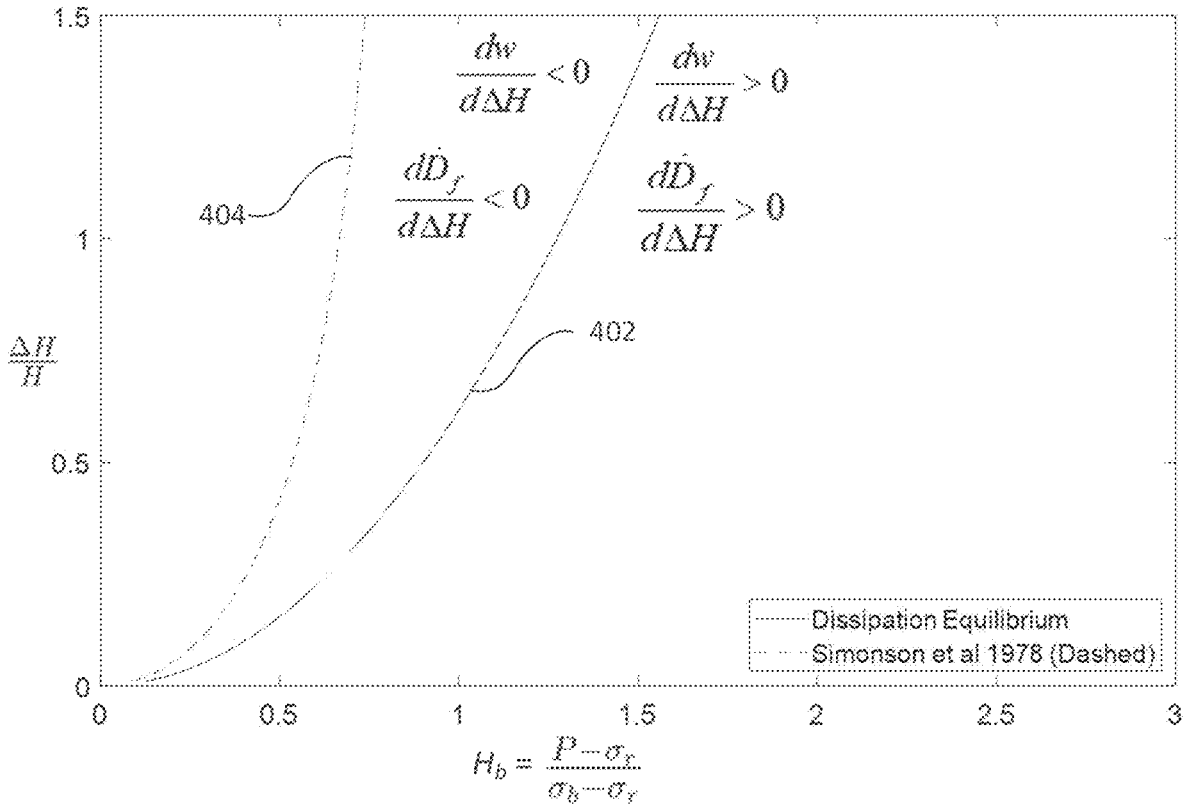
FIG. 4 illustrates an example dissipation equilibrium line.

To control the growth of fractures during well operations, a dissipation equilibrium line may be used to determine pressure limit for the well operations. Pressure limit may refer to a value of pressure that should not be exceeded during the well operations. FIG. 4 illustrates an example dissipation equilibrium line 402. The dissipation equilibrium line 402 may match values of fracture height-change ratios (ratio of (1) change in height of a fracture to (2) the initial height of the fracture) ($\Delta H/H$) to dissipation equilibrium values ($H_b$). The dissipation equilibrium value may be equal to a ratio of (1) difference between the pressure and the layer stress to (2) difference between the bounding layer stress and the layer stress ($H_b=(P-\sigma_r)/(\sigma_b-\sigma_r)$).

Also shown in FIG. 4 is a line 404 proposed by Simonson et al. The line 404 may be generated by assuming highest growth possible for fracture growth into the bounding layer (barrier formation). That is, if a fracture could grow into the bounding layer, the line 404 may assume that the fracture will expand into the highest growth. The line 404 may provide conservative approach in controlling pressure in the layer to prevent vertical fracture growth.

The dissipation equilibrium line 402 may be generated by taking into account thermodynamics of fracture growth into the bounding layer. The dissipation equilibrium line 402 may be generated by determining not simply whether a fracture will grow, but also the direction in which the fracture will grow. The dissipation equilibrium line 402 may assume that even if the fracture could grow into the bounding layer, if growth into the bounding layer (higher stress layer) represents a higher energy state than not growing into the bounding layer, then the fracture will stay in the lower stress layer.

The dissipation equilibrium line 402 may follow along a curve in which there is no change in dissipation rate of fluid flow ($D_f$) with change in fracture height ($\Delta H$). The dissipation equilibrium line 402 may separate pressure values resulting in a negative change in dissipation rate of fluid flow from pressure values resulting in a positive change in dissipation rate of fluid flow. To the left of the dissipation equilibrium line 402, the dissipation rate of fluid flow may decrease with increase in fracture height. To the right of the dissipation equilibrium line 402, the dissipation rate of fluid flow may increase with increase in fracture height. Along the dissipation equilibrium line 402, the dissipation rate of fluid flow may not change with increase in fracture height.

The dissipation equilibrium line 402 may follow along a curve in which there is no change in width of the fracture (w) with change in fracture height ($\Delta H$). The dissipation equilibrium line 402 may separate pressure values resulting in a negative change in width from separate pressure values resulting in a positive change in width of the fracture. To the left of the dissipation equilibrium line 402, the width of the fracture may decrease with increase in fracture height. To the right of the dissipation equilibrium line 402, the width of the fracture may increase with increase in fracture height. Along the dissipation equilibrium line 402, the width of the fracture may not change with increase in fracture height.

By taking into account thermodynamics of fracture growth into the bounding layer, the dissipation equilibrium line 402 may be plotted using the following relationship:

$$H_b = \alpha^{1/2}\frac{4}{\pi}, \text{ where } \alpha = \frac{\Delta H}{H}$$

The usage of the dissipation equilibrium line 402 may allow a well operation to be safely performed with higher pressure than the usage of the line 404. The value of the pressure for a given change in fracture height may be higher for the dissipation equilibrium line 402 than for the line 404. For example, if a fracture is allowed to grow by 50% from its initial height ($\Delta H/H=0.5$), then the dissipation equilibrium value ($H_b$) may be about 0.9 according to the dissipation equilibrium line 402. For the same allowed fracture height growth, the line 404 may provide a value of about 0.5. The higher value of the dissipation equilibrium value for the same allowed fracture height growth may result in higher pressure being allowed to safely perform the well operation. That is, the higher value of the dissipation equilibrium value may correspond to higher pressure limit being allowed to safely perform the well operation.

In some implementations, the usage of the dissipation equilibrium line to calculate the dissipation equilibrium value ($H_b$) may be limited to one or more circumstances. For example, the usage of the dissipation equilibrium line to calculate the dissipation equilibrium value ($H_b$) may be limited to circumstances in which (1) a non-slipping interface exists between the layer (e.g., target/reservoir layer) and the bounding layer, and (2) the maximum amount by which the fracture is allowed to grow vertically ($\Delta H_{limit}$) being less than the initial height of the fracture (H).

Figure 5:
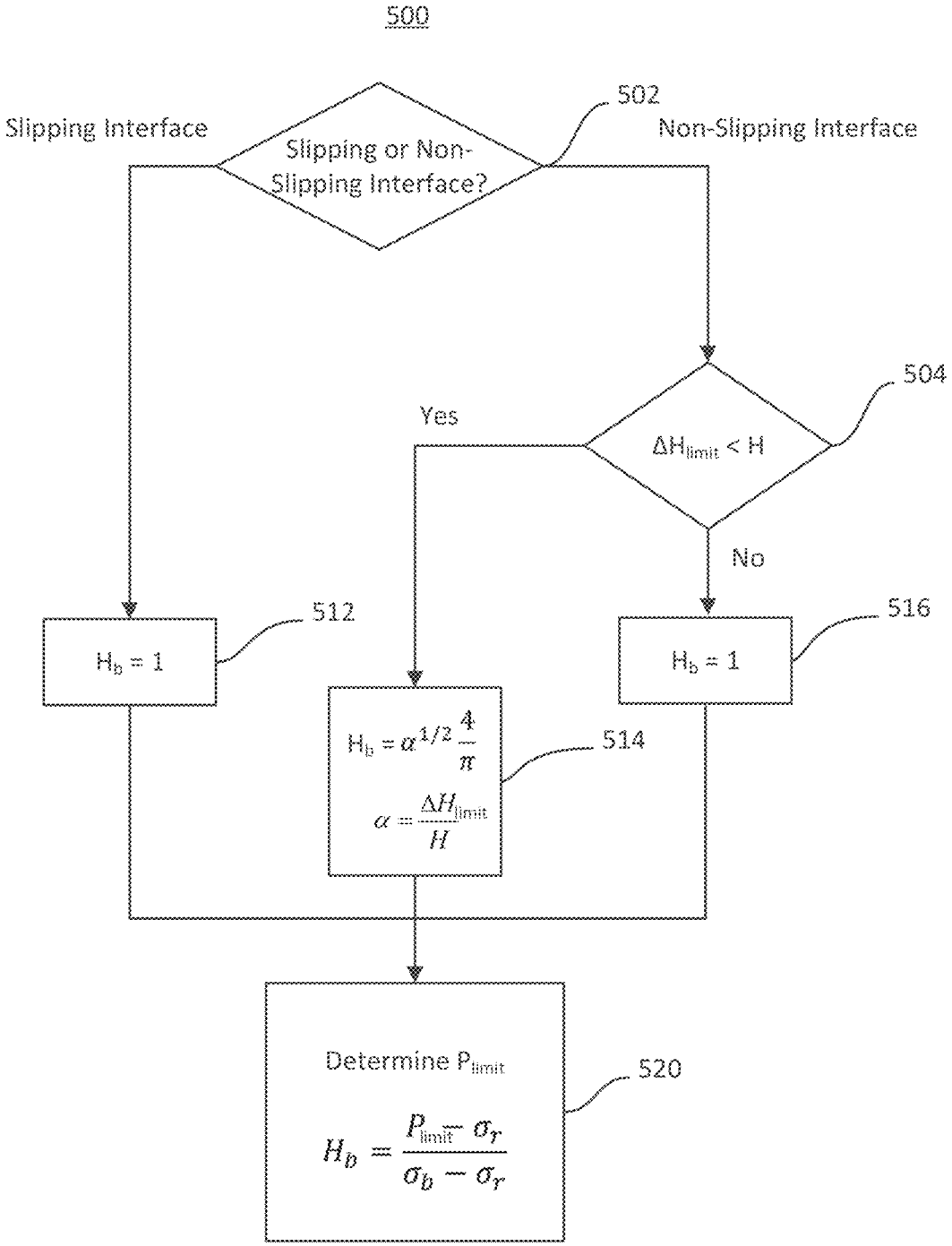
FIG. 5 illustrates an example workflow for controlling fracture growth during operation of a well.

FIG. 5 illustrates an example workflow 500 for controlling fracture growth during operation of a well. At step 502, whether a slipping or a non-slipping interface exist between a layer and a bounding layer may be determined. A non-slipping interface between the layer and the boundary layer may result in no slippage between the layer and the boundary layer when fracture occurs at the interface. A slipping interface between the layer and the boundary layer may result in slippage between the layer and the boundary layer when fracture occurs at the interface.

At step 512, responsive to a slipping interface existing between the layer and the bounding layer, the dissipation equilibrium value for the well operation may be determined as one ($H_b=1$). Rather than using the dissipation equilibrium line 402 to find the dissipation equilibrium value ($H_b$), the dissipation equilibrium value for the well operation may be set to one.

Responsive to a non-slipping interface existing between the layer and the bounding layer, at step 504, the maximum amount by which the fracture is allowed to grow vertically ($\Delta H_{limit}$) may be compared to the initial height of the fracture (H). Responsive to the limit on change of the height of the fracture during the well operation being less than the height of the fracture ($\Delta H_{limit}<H$), the dissipation equilibrium value for the well operation may be determined based on the height of the fracture and the limit on change of the height of the fracture during the well operation as shown in step 514. Responsive to the limit on change of the height of the fracture during the well operation being greater than the height of the fracture ($\Delta H_{limit}>H$), the dissipation equilibrium value for the well operation may be determined as one ($H_b=1$) in step 516. Rather than using the dissipation equilibrium line 402 to find the dissipation equilibrium value ($H_b$), the dissipation equilibrium value for the well operation may be set to one.

At step 520, the pressure limit ($P_{limit}$) for the well operation may be determined based on the dissipation equilibrium value ($H_b$), the layer stress ($\sigma_r$), and the bounding layer stress ($\sigma_b$). The pressure limit ($P_{limit}$) for the well operation may be determined using the following relationship:

$$H_b = \frac{P_{limit} - \sigma_r}{\sigma_b - \sigma_r}$$

In some implementations, the above relationship and the dissipation equilibrium line may be used to determine values of stress in the layer and/or the bounding layer. For example, change in height of the fracture may be measured as a function of pressure. The change in height of the fracture may be used to determine the dissipation equilibrium value ($H_b$). Dissipation equilibrium value ($H_b$) and the measured pressure may be used to determine the layer stress ($\sigma_r$) and/or the bounding layer stress ($\sigma_b$). The layer stress ($\sigma_r$) and/or the bounding layer stress ($\sigma_b$) determined using the above relationship may be used to calibrate one or more mechanical earth models.

Referring back to FIG. 1, the processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate controlling fracture growth during operation of a well. The machine-readable instructions 100 may include one or more computer program components. The machine-readable instructions 100 may include a fracture component 102, a fracture limit component 104, a layer stress component 106, a bounding layer stress component 108, a dissipation component 110, a pressure limit component 112, a control component 114, and/or other computer program components.

The fracture component 102 may be configured to obtain fracture information for a layer and/or other information. Obtaining fracture information may include one or more of accessing, acquiring, analyzing, determining, examining, identifying, loading, locating, opening, receiving, retrieving, reviewing, selecting, storing, and/or otherwise obtaining the fracture information. The fracture component 102 may obtain fracture information from one or more locations. For example, the fracture component 102 may obtain fracture information from a storage location, such as the electronic storage 13, electronic storage of a device accessible via a network, and/or other locations. The fracture component 102 may obtain fracture information from one or more hardware components (e.g., a computing device) and/or one or more software components (e.g., software running on a computing device). In some implementations, the fracture information may be obtained from one or more users. For example, a user may interact with a computing device to input the fracture information (e.g., enter value that reflects a height of a fracture within a layer).

The fracture information for the layer may characterize a height of a fracture within the layer. The layer for which the fracture information is obtained may include a reservoir layer, a target layer, and/or other layer. For example, the fracture information may be obtained for a reservoir layer in which hydrocarbons are stored. The fracture information may be obtained for a target layer in which a well operation is to be performed (e.g., a layer for waterflooding). The fracture information may be obtained for other layers.

The fracture may refer to a primary fracture and/or other fracture within the layer. A height of a fracture may refer to the distance between the top of the fracture and the bottom of the fracture. A height of a fracture may be equal to the height of the layer (e.g., the reservoir layer, the target layer). The fracture information may characterize the height of the fracture within the layer by describing, defining, and/or otherwise characterizing the height of the fracture within the layer.

The fracture information may characterize the height of the fracture within the layer by including information that describes, delineates, defines, identifies, is associated with, quantifies, reflects, sets forth, and/or otherwise characterizes one or more of value, property, quality, quantity, attribute, feature, and/or other aspects of the height of the fracture within the layer. For example, the fracture information may characterize the height of the fracture within the layer by including information that specifies value of height of the fracture within the layer and/or information that may be used to determine the value of height of the fracture within the layer. Other types of fracture information are contemplated.

The fracture limit component 104 may be configured to obtain fracture limit information for the fracture and/or other information. Obtaining fracture limit information may include one or more of accessing, acquiring, analyzing, determining, examining, identifying, loading, locating, opening, receiving, retrieving, reviewing, selecting, storing, and/or otherwise obtaining the fracture limit information. The fracture limit component 104 may obtain fracture limit information from one or more locations. For example, the fracture limit component 104 may obtain fracture limit information from a storage location, such as the electronic storage 13, electronic storage of a device accessible via a network, and/or other locations. The fracture limit component 104 may obtain fracture limit information from one or more hardware components (e.g., a computing device) and/or one or more software components (e.g., software running on a computing device). In some implementations, the fracture limit information may be obtained from one or more users. For example, a user may interact with a computing device to input the fracture limit information (e.g., enter value that reflects the limit on change of the height of the fracture during a well operation).

The fracture limit information for the fracture may characterize a limit on change of the height of the fracture during a well operation. A well operation may refer to an operation relating to a well. A well operation may refer to performance of work on and/or using a well. A well operation may include one or more tasks. A well operation may be associated with one or more stages of well usage, such as a well design stage, a well site preparation stage (preparation of aboveground infrastructure, such as pads and access roads), a drilling stage (drilling the well), a cementing stage (well casing insertion and cementing), a well completion stage (making the well ready for production), a production stage (recovery of natural resources), a well abandonment stage (plugging, capping, etc.), and/or other stages. For example, a well operation may include fluid injection, such as for waterflooding and/or other applications. Other well operations are contemplated.

The limit on change of the height of the fracture during a well operation may refer to a limit on how much the fracture is allowed to grow vertically during the well operation. The limit on change of the height of the fracture during a well operation may be referred to as $\Delta H_{limit}$, such as $\Delta H_{limit}$ shown in FIG. 3. The limit on change of the height of the fracture during a well operation may refer to a desired limitation on the vertical growth of the fracture during the well operations. For example, the limit on change of the height of the fracture during the well operation may include the maximum amount by which the height of the fracture is allowed to be changed during the well operation. For instance, the limit on change of the height of the fracture during the well operation may include the maximum amount by which the height of the fracture is allowed to grow during fluid injection. For example, referring to FIG. 3, the value of $\Delta H_{limit}$ during the fluid injection 340 may be set so that the fracture expansion 350 does not go beyond the top of the bounding layer 320. This may result in the fracture 330 being contained by the bounding layer 320 during the fluid injection 340.

The fracture limit information may characterize a limit on change of the height of the fracture during a well operation by including information that describes, delineates, defines, identifies, is associated with, quantifies, reflects, sets forth, and/or otherwise characterizes one or more of value, property, quality, quantity, attribute, feature, and/or other aspects of the limit on change of the height of the fracture during the well operation. For example, the fracture limit information may characterize the limit on change of the height of the fracture during the well operation by including information that specifies value of the limit on change of the height of the fracture during the well operation and/or information that may be used to determine the value of the limit on change of the height of the fracture during the well operation. Other types of fracture limit information are contemplated.

The layer stress component 106 may be configured to obtain layer stress information for the layer and/or other information. Obtaining layer stress information may include one or more of accessing, acquiring, analyzing, determining, examining, identifying, loading, locating, opening, receiving, retrieving, reviewing, selecting, storing, and/or otherwise obtaining the layer stress information. The layer stress component 106 may obtain layer stress information from one or more locations. For example, the layer stress component 106 may obtain layer stress information from a storage location, such as the electronic storage 13, electronic storage of a device accessible via a network, and/or other locations. The layer stress component 106 may obtain layer stress information from one or more hardware components (e.g., a computing device) and/or one or more software components (e.g., software running on a computing device). In some implementations, the layer stress information may be obtained from one or more users. For example, a user may interact with a computing device to input the layer stress information (e.g., enter value that reflects the stress in the layer).

The layer stress information for the layer may characterize stress in the layer. Stress in the layer may refer to the force per unit area that is placed on the layer/materials within the layer. Stress in the layer may keep the materials within the layer together. Stress in the layer may oppose force that attempts to separate materials within the layer. For example, stress in the layer may include horizontal stress. If the horizontal stress is overcome (e.g., via pressure induced by fluid injection), the fracture within the layer may grow vertically. Other types of stress are contemplated.

The layer stress information may characterize the stress in the layer by including information that describes, delineates, defines, identifies, is associated with, quantifies, reflects, sets forth, and/or otherwise characterizes one or more of value, property, quality, quantity, attribute, feature, and/or other aspects of the stress in the layer. For example, the layer stress information may characterize the stress in the layer by including information that specifies value of the stress in the layer and/or information that may be used to determine the value of the stress in the layer. Other types of layer stress information are contemplated.

In some implementations, the layer stress information may be obtained/updated during the well operation. For example, the layer stress information may be monitored during the well operation to detect any change in the stress in the layer during the well operation. Change in the stress in the layer may require the redetermination of dissipation equilibrium value for the well operation and/or the redetermination of pressure limit for the operation.

The bounding layer stress component 108 may be configured to obtain bounding layer stress information for a bounding layer and/or other information. Obtaining bounding layer stress information may include one or more of accessing, acquiring, analyzing, determining, examining, identifying, loading, locating, opening, receiving, retrieving, reviewing, selecting, storing, and/or otherwise obtaining the bounding layer stress information. The bounding layer stress component 108 may obtain bounding layer stress information from one or more locations. For example, the bounding layer stress component 108 may obtain bounding layer stress information from a storage location, such as the electronic storage 13, electronic storage of a device accessible via a network, and/or other locations. The bounding layer stress component 108 may obtain bounding layer stress information from one or more hardware components (e.g., a computing device) and/or one or more software components (e.g., software running on a computing device). In some implementations, the bounding layer stress information may be obtained from one or more users. For example, a user may interact with a computing device to input the bounding layer stress information (e.g., enter value that reflects the stress in the bounding layer).

The bounding layer may be above the layer. The bounding layer may operate as a barrier layer that contains vertical growth of the fracture in the layer. The bounding layer may limit the extent to which the fracture grows in the bounding layer. The bounding layer stress information for the bounding layer may characterize stress in the bounding layer. Stress in the bounding layer may refer to the force per unit area that is placed on the layer/materials within the bounding layer. Stress in the bounding layer may keep the materials within the bounding layer together. Stress in the bounding layer may oppose force that attempts to separate materials within the bounding layer. For example, stress in the bounding layer may include horizontal stress. If the horizontal stress is overcome (e.g., via pressure induced by fluid injection), the fracture within the layer may grow vertically into the bounding layer. The stress in the bounding layer may be greater than the stress in the layer. Other types of stress are contemplated.

The bounding layer stress information may characterize the stress in the bounding layer by including information that describes, delineates, defines, identifies, is associated with, quantifies, reflects, sets forth, and/or otherwise characterizes one or more of value, property, quality, quantity, attribute, feature, and/or other aspects of the stress in the bounding layer. For example, the bounding layer stress information may characterize the stress in the bounding layer by including information that specifies value of the stress in the bounding layer and/or information that may be used to determine the value of the stress in the bounding layer. Other types of bounding layer stress information are contemplated.

In some implementations, the bounding layer stress information may be obtained/updated during the well operation. For example, the bounding layer stress information may be monitored during the well operation to detect any change in the stress in the bounding layer during the well operation. Change in the stress in the bounding layer may require the redetermination of dissipation equilibrium value for the well operation and/or the redetermination of pressure limit for the operation.

The dissipation component 110 may be configured to determine a dissipation equilibrium value for the well operation. Determining the dissipation equilibrium value may include ascertaining, approximating, calculating, establishing, estimating, finding, identifying, obtaining, quantifying, and/or otherwise determining the dissipation equilibrium value. Dissipation equilibrium value for the well operation may refer to a value of the dissipation equilibrium line corresponding to a fracture height-change ratio (ΔH/H) in the well operation. Dissipation equilibrium value for the well operation may refer to a value equal to a ratio of (1) difference between pressure and the layer stress to (2) difference between the bounding layer stress and the layer stress ($H_b=(P-\sigma_r)/(\sigma_b-\sigma_r)$) for the well operation.

The dissipation equilibrium value for the well operation may be determined based on the height of the fracture (H), the limit on change of the height of the fracture during the well operation ($\Delta H_{limit}$), and/or other information. In some implementations, the dissipation equilibrium value may be determined based on a ratio of the limit on change of the height of the fracture during the well operation to the height of the fracture. The dissipation equilibrium value ($H_b$) for the well operation may be determined using the following relationship:

$$H_b = \alpha^{1/2}\frac{4}{\pi}, \text{ where } \alpha = \frac{\Delta H}{H}$$

In some implementations, the dissipation equilibrium value may be a point on a dissipation equilibrium line, such as the dissipation equilibrium line 402 shown in FIG. 4. Different points on the dissipation equilibrium line may be associated with different limits on change of the height of the fracture during the well operation and different pressure limits for the well operation. For example, in FIG. 4, different dissipation equilibrium values are shown along the x-axis, and different ratios of change of the height of the fracture to the height of the fracture are shown along the y-axis. Different dissipation equilibrium values may correspond to different values of pressure during the well operation.

In some implementations, the dissipation equilibrium value for the well operation may be determined based on the height of the fracture and the limit on change of the height of the fracture during the well operation responsive to (1) a non-slipping interface existing between the layer and the bounding layer, and (2) the limit on change of the height of the fracture during the well operation being less than the height of the fracture. The dissipation equilibrium value calculated using the ratio of change of the height of the fracture to the height of the fracture may be valid if (1) a non-slipping interface existing between the layer and the bounding layer, and (2) the limit on change of the height of the fracture during the well operation is less than the height of the fracture ($\Delta H_{limit}<H$) (see middle path of the workflow 500 in FIG. 5).

In some implementations, the dissipation equilibrium value for the well operation may be determined as one responsive to a slipping interface existing between the layer and the bounding layer. Rather than using the dissipation equilibrium line to find the dissipation equilibrium value corresponding to the limit on change of the height of the fracture, the value of one may be used as the dissipation equilibrium value for the well operation based on a slipping interface existing between the layer and the bounding layer (see left path of the workflow 500 in FIG. 5).

In some implementations, the dissipation equilibrium value for the well operation may be determined as one responsive to (1) a non-slipping interface existing between the layer and the boundary layer, and (2) the limit on change of the height of the fracture during the well operation being greater than the height of the fracture. Rather than using the dissipation equilibrium line to find the dissipation equilibrium value corresponding to the limit on change of the height of the fracture, the value of one may be used as the dissipation equilibrium value for the well operation based (1) the non-slipping interface existing between the layer and the boundary layer, and (2) the limit on change of the height of the fracture during the well operation being greater than the height of the fracture ($\Delta H_{limit}>H$) (see right path of the workflow 500 in FIG. 5).

The pressure limit component 112 may be configured to determine a pressure limit for the well operation. Determining the pressure limit may include ascertaining, approximating, calculating, establishing, estimating, finding, identifying, obtaining, quantifying, and/or otherwise determining the pressure limit. A pressure limit for a well operation may refer to a value of pressure that should not be exceeded during the well operation. For example, the well operation may include fluid injection, and the pressure limit may refer to an injection pressure limit (a value of pressure that should not be exceeded during the fluid injection).

The pressure limit for the well operation may be determined based on the dissipation equilibrium value ($H_b$), the stress in the layer (σr), the stress in the bounding layer (σr), and/or other information. The pressure limit ($P_{limit}$) for the well operation may be determined using the following relationship:

$$H_b = \frac{P_{limit} - \sigma_r}{\sigma_b - \sigma_r}$$

The pressure limit ($P_{limit}$) for the well operation may be equal to product of the dissipation equilibrium value and the difference between the stress in the bounding layer and the stress in the layer, plus the stress in the layer. Thus, higher value of the dissipation equilibrium value may result in higher pressure limit and lower value of the dissipation equilibrium value may result in lower pressure limit. In some implementations, stresses in the layer and/or the bounding layer may change during the well operation, and the pressure limit for the well operation may be recalculated using updated value(s) of the stresses in the layer and/or the bounding layer.

Use of the pressure limit determined using the above relationship may increase efficiency of the well operation. Use of the pressure limit determined using the above relationship may allow the well operation to safely proceed using high pressure while keeping the fracture height grown contained within the bounding layer.

The control component 114 may be configured to facilitate use of the pressure limit. Facilitating the use of the pressure limit may include presentation of the pressure limit via a display, using the pressure limit to control the pressure of the well, and/or other facilitation of the use of the pressure limit. Facilitating the use of the pressure limit may include use of the pressure limit in planning a well design, use of the pressure limit in drilling and completion of a new well, use of the pressure limit in an existing well, use of the pressure limit in planning operation of the well, and/or use of the pressure limit in safely carrying out operation at the well.

The pressure of the well may refer to the pressure in the well, the pressure in one or more subsurface layers penetrated by the well (e.g., the layer including the fracture, the bounding layer), the pressure in the fracture, the pressure maintained by the well, and/or other pressure of the well.

For example, the pressure limit may be presented on one or more displays to a person engaged in the well operation. The person may use the presented pressure limit during the well operation. For example, the person may monitor the pressure of the well to make sure that the pressure of the well does not exceed or approach the pressure limit. The person may make changes to the well operation to lower the pressure of the well based on the pressure of the well coming close to or exceeding the pressure limit.

The pressure limit may be used to control pressure of the well during the well operation. For example, for a well used in fluid injection, the pressure limit (injection pressure limit) may be used to automatically control injection pressure of the well during the fluid injection. In some implementations, controlling the pressure of the well using the pressure limit may include controlling the pressure of the well such that the pressure of the well does not rise above (exceed) the pressure limit. For example, injection pressure of a well used for fluid injection may be automatically controlled such that the injection pressure of the well does not rise above the injection pressure limit. Keeping the pressure of the well below the pressure limit may prevent fracture growth that exceeds the limit on change of the height of the fracture during the well operation. Keeping the pressure of the well below the pressure limit may keep the fracture growth contained within the bounding layer. Keeping the pressure of the well below the pressure limit may reduce (e.g., minimize, eliminate) the risk of the fracture growing beyond the bounding layer. Other uses of the pressure limit are contemplated.

Implementations of the disclosure may be made in hardware, firmware, software, or any suitable combination thereof. Aspects of the disclosure may be implemented as instructions stored on a machine-readable medium, which may be read and executed by one or more processors. A machine-readable medium may include any mechanism for storing or transmitting information in a form readable by a machine (e.g., a computing device). A machine-readable medium may include non-transitory computer-readable medium. For example, a tangible computer-readable storage medium may include read-only memory, random access memory, magnetic disk storage media, optical storage media, flash memory devices, and others, and a machine-readable transmission media may include forms of propagated signals, such as carrier waves, infrared signals, digital signals, and others. Firmware, software, routines, or instructions may be described herein in terms of specific exemplary aspects and implementations of the disclosure, and performing certain actions.

In some implementations, some or all of the functionalities attributed herein to the system 10 may be provided by external resources not included in the system 10. External resources may include hosts/sources of information, computing, and/or processing and/or other providers of information, computing, and/or processing outside of the system 10.

Although the processor 11, the electronic storage 13, and the display 14 are shown to be connected to the interface 12 in FIG. 1, any communication medium may be used to facilitate interaction between any components of the system 10. One or more components of the system 10 may communicate with each other through hard-wired communication, wireless communication, or both. For example, one or more components of the system 10 may communicate with each other through a network. For example, the processor 11 may wirelessly communicate with the electronic storage 13. By way of non-limiting example, wireless communication may include one or more of radio communication, Bluetooth communication, Wi-Fi communication, cellular communication, infrared communication, or other wireless communication. Other types of communications are contemplated by the present disclosure.

Although the processor 11, the electronic storage 13, and the display 14 are shown in FIG. 1 as single entities, this is for illustrative purposes only. One or more of the components of the system 10 may be contained within a single device or across multiple devices. For instance, the processor 11 may comprise a plurality of processing units. These processing units may be physically located within the same device, or the processor 11 may represent processing functionality of a plurality of devices operating in coordination. The processor 11 may be separate from and/or be part of one or more components of the system 10. The processor 11 may be configured to execute one or more components by software; hardware; firmware; some combination of software, hardware, and/or firmware; and/or other mechanisms for configuring processing capabilities on the processor 11. The system 10 may be implemented in a single computing device, across multiple computing devices, in a client-server environment, in a cloud environment, and/or in other devices/configuration of devices. The system 10 may be implemented using a computer, a desktop, a laptop, a phone, a tablet, a mobile device, a server, and/or other computing devices.

It should be appreciated that although computer program components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented.

The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

The electronic storage media of the electronic storage 13 may be provided integrally (i.e., substantially non-removable) with one or more components of the system 10 and/or as removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

Figure 2:
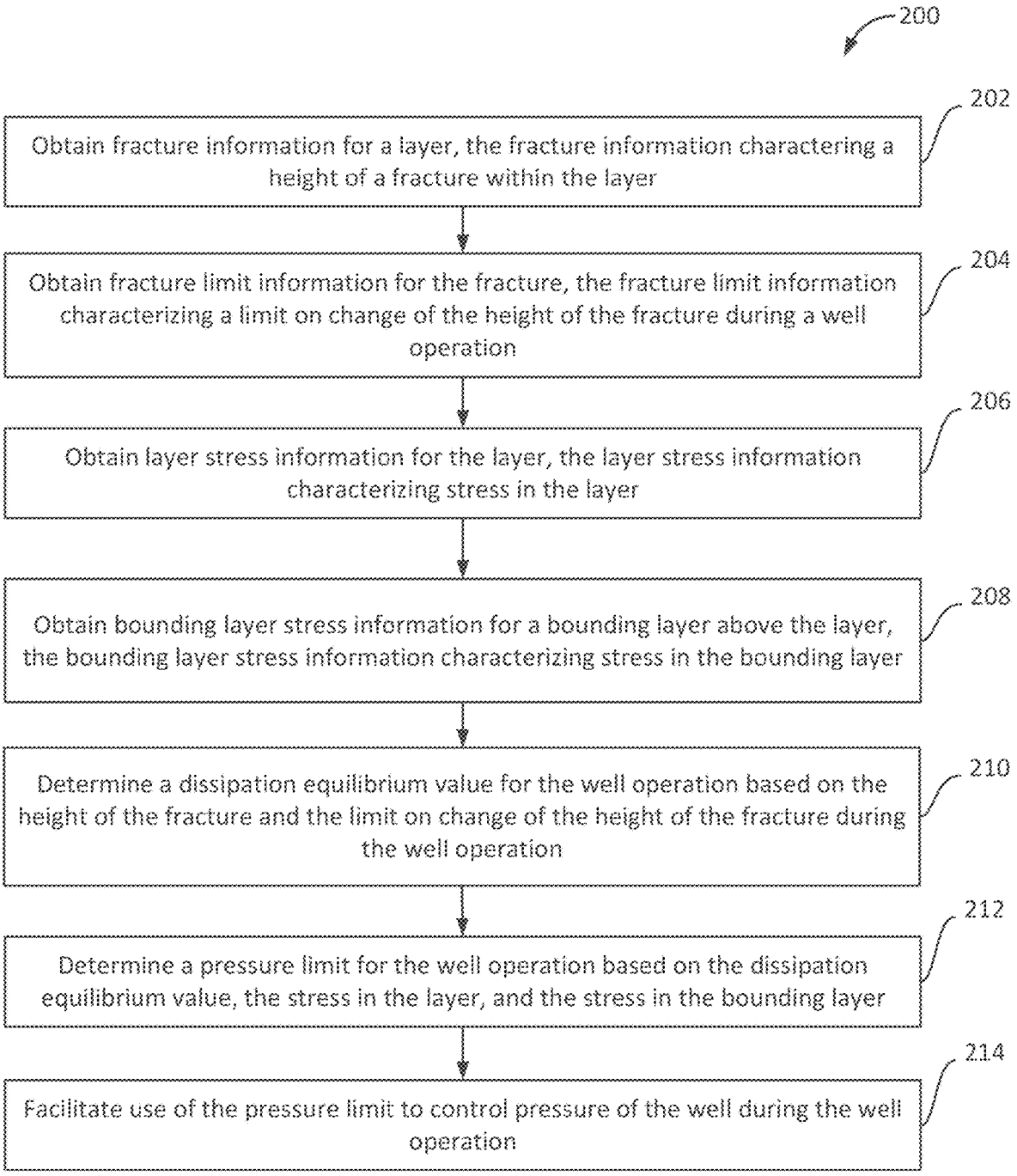
FIG. 2 illustrates an example method for controlling fracture growth during operation of a well.

FIG. 2 illustrates method 200 for controlling fracture growth during operation of a well. The operations of method 200 presented below are intended to be illustrative. In some implementations, method 200 may be accomplished with one or more additional operations not described, and/or without one or more of the operations discussed. In some implementations, two or more of the operations may occur substantially simultaneously.

In some implementations, method 200 may be implemented in one or more processing devices (e.g., a digital processor, an analog processor, a digital circuit designed to process information, a central processing unit, a graphics processing unit, a microcontroller, an analog circuit designed to process information, a state machine, and/or other mechanisms for electronically processing information). The one or more processing devices may include one or more devices executing some or all of the operations of method 200 in response to instructions stored electronically on one or more electronic storage media. The one or more processing devices may include one or more devices configured through hardware, firmware, and/or software to be specifically designed for execution of one or more of the operations of method 200.

Referring to FIG. 2 and method 200, at operation 202, fracture information for a layer may be obtained. Fracture information for the layer may characterize a height of a fracture within the layer. In some implementation, operation 202 may be performed by a processor component the same as or similar to the fracture component 102 (Shown in FIG. 1 and described herein).

At operation 204, fracture limit information for the fracture may be obtained. The fracture limit information for the fracture may characterize a limit on change of the height of the fracture during a well operation. In some implementation, operation 204 may be performed by a processor component the same as or similar to the fracture limit component 104 (Shown in FIG. 1 and described herein).

At operation 206, layer stress information for the layer may be obtained. The layer stress information for the layer may characterize stress in the layer. In some implementation, operation 206 may be performed by a processor component the same as or similar to the layer stress component 106 (Shown in FIG. 1 and described herein).

At operation 208, bounding layer stress information for a bounding layer above the layer may be obtained. The bounding layer stress information for the bounding layer above the layer may characterize stress in the bounding layer. In some implementation, operation 208 may be performed using a processor component the same as or similar to the bounding layer stress component 108 (Shown in FIG. 1 and described herein).

At operation 210, a dissipation equilibrium value for the well operation may be determined based on the height of the fracture and the limit on change of the height of the fracture during the well operation. In some implementation, operation 210 may be performed using a processor component the same as or similar to the dissipation component 110 (Shown in FIG. 1 and described herein).

At operation 212, a pressure limit for the well operation may be determined based on the dissipation equilibrium value, the stress in the layer, and the stress in the bounding layer. In some implementation, operation 212 may be performed using a processor component the same as or similar to the pressure limit component 112 (Shown in FIG. 1 and described herein).

At operation 214, use of the pressure limit to control pressure of the well during the well operation may be facilitated. In some implementation, operation 214 may be performed using a processor component the same as or similar to the control component 114 (Shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system for controlling fracture growth during operation of a well, the system comprising:

one or more physical processors configured by non-transitory machine-readable instructions to:

obtain fracture information for a layer, the fracture information characterizing a height of a fracture within the layer;

obtain fracture limit information for the fracture, the fracture limit information characterizing a limit on change of the height of the fracture during fluid injection at an injection well in a reservoir;

obtain layer stress information for the layer, the layer stress information characterizing stress in the layer;

obtain bounding layer stress information for a bounding layer above the layer, the bounding layer stress information characterizing stress in the bounding layer;

determine a dissipation equilibrium value for the fluid injection at the injection well based on the height of the fracture and the limit on change of the height of the fracture during the fluid injection at the injection well;

determine an injection pressure limit for the fluid injection at the injection well based on the dissipation equilibrium value, the stress in the layer, and the stress in the bounding layer; and perform the fluid injection at the injection well based on the injection pressure limit determined using the dissipation equilibrium value, the stress in the layer, and the stress in the bounding layer, the fluid injection at the injection well promoting recovery of hydrocarbon through one or more production wells in the reservoir, wherein the injection pressure of the injection well is automatically controlled to not rise above the injection pressure limit, further wherein automatically preventing the injection pressure from rising above the injection pressure limit contains growth of the fracture within the bounding layer during the fluid injection.

2. The system of claim 1, wherein the fluid injection includes waterflooding.

3. The system of claim 2, wherein the waterflooding displaces or sweeps oil in the reservoir.

4. The system of claim 1, wherein the limit on change of the height of the fracture during the well operation includes a maximum amount by which the height of the fracture is allowed to be changed during the fluid injection at the injection well.

5. The system of claim 1, wherein the dissipation equilibrium value is determined based on a ratio of the limit on change of the height of the fracture during the fluid injection at the injection well to the height of the fracture.

6. The system of claim 5, wherein the dissipation equilibrium value is a point on a dissipation equilibrium line, the point associated with the limit on change of the height of the fracture during the fluid injection at the injection well and the injection pressure limit for the fluid injection at the injection well.

7. The system of claim 6, wherein the dissipation equilibrium line separates pressure values resulting in a negative change in dissipation rate of fluid flow from pressure values resulting in a positive change in dissipation rate of fluid flow.

8. The system of claim 1, wherein the dissipation equilibrium value for the fluid injection at the injection well is determined based on the height of the fracture and the limit on change of the height of the fracture during the fluid injection at the injection well responsive to a non-slipping interface existing between the layer and the bounding layer, and the limit on change of the height of the fracture during the fluid injection at the injection well being less than the height of the fracture.

9. The system of claim 8, wherein the dissipation equilibrium value for the fluid injection at the injection well is determined as one responsive to a slipping interface existing between the layer and the bounding layer.

10. The system of claim 9, wherein the dissipation equilibrium value for the fluid injection at the injection well is determined as one responsive to the non-slipping interface existing between the layer and the boundary layer, and the limit on change of the height of the fracture during the fluid injection at the injection well being greater than the height of the fracture.

11. A method for controlling fracture growth during operation of a well, the method comprising:

obtaining fracture information for a layer, the fracture information characterizing a height of a fracture within the layer;

obtaining fracture limit information for the fracture, the fracture limit information characterizing a limit on change of the height of the fracture during fluid injection at an injection well in a reservoir;

obtaining layer stress information for the layer, the layer stress information characterizing stress in the layer;

obtaining bounding layer stress information for a bounding layer above the layer, the bounding layer stress information characterizing stress in the bounding layer;

determining a dissipation equilibrium value for the fluid injection at the injection well based on the height of the fracture and the limit on change of the height of the fracture during the fluid injection at the injection well;

determining an injection pressure limit for the fluid injection at the injection well based on the dissipation equilibrium value, the stress in the layer, and the stress in the bounding layer; and performing the fluid injection at the injection well based on the injection pressure limit determined using the dissipation equilibrium value, the stress in the layer, and the stress in the bounding layer, the fluid injection at the injection well promoting recovery of hydrocarbon through one or more production wells in the reservoir, wherein the injection pressure of the injection well is automatically controlled to not rise above the injection pressure limit, further wherein automatically preventing the injection pressure from rising above the injection pressure limit contains growth of the fracture within the bounding layer during the fluid injection.

12. The method of claim 11, wherein the fluid injection includes waterflooding.

13. The method of claim 12, wherein the waterflooding displaces or sweeps oil in the reservoir.

14. The method of claim 11, wherein the limit on change of the height of the fracture during the well operation includes a maximum amount by which the height of the fracture is allowed to be changed during the fluid injection at the injection well.

15. The method of claim 11, wherein the dissipation equilibrium value is determined based on a ratio of the limit on change of the height of the fracture during the fluid injection at the injection well to the height of the fracture.

16. The method of claim 15, wherein the dissipation equilibrium value is a point on a dissipation equilibrium line, the point associated with the limit on change of the height of the fracture during the fluid injection at the injection and the injection pressure limit for the fluid injection at the injection well.

17. The method of claim 16, wherein the dissipation equilibrium line separates pressure values resulting in a negative change in dissipation rate of fluid flow from pressure values resulting in a positive change in dissipation rate of fluid flow.

18. The method of claim 11, wherein the dissipation equilibrium value for the fluid injection at the injection well is determined based on the height of the fracture and the limit on change of the height of the fracture during the fluid injection at the injection well responsive to a non-slipping interface existing between the layer and the bounding layer, and the limit on change of the height of the fracture during the fluid injection at the injection well being less than the height of the fracture.

19. The method of claim 18, wherein the dissipation equilibrium value for the fluid injection at the injection well is determined as one responsive to a slipping interface existing between the layer and the bounding layer.

20. The method of claim 19, wherein the dissipation equilibrium value for the fluid injection at the injection well is determined as one responsive to the non-slipping interface existing between the layer and the boundary layer, and the limit on change of the height of the fracture during the fluid injection at the injection well being greater than the height of the fracture.

21. A non-transitory computer-readable medium having computer-executable instructions stored thereon which, when executed by a computer, cause the computer to control fracture growth during operation of a well by executing steps comprising:

obtaining fracture information for a layer, the fracture information characterizing a height of a fracture within the layer;

obtaining fracture limit information for the fracture, the fracture limit information characterizing a limit on change of the height of the fracture during fluid injection at an injection well in a reservoir;

obtaining layer stress information for the layer, the layer stress information characterizing stress in the layer;

obtaining bounding layer stress information for a bounding layer above the layer, the bounding layer stress information characterizing stress in the bounding layer;

determining a dissipation equilibrium value for the fluid injection at the injection well based on the height of the fracture and the limit on change of the height of the fracture during the fluid injection at the injection well;

determining an injection pressure limit for the fluid injection at the injection well based on the dissipation equilibrium value, the stress in the layer, and the stress in the bounding layer; and performing the fluid injection at the injection well based on the injection pressure limit determined using the dissipation equilibrium value, the stress in the layer, and the stress in the bounding layer, the fluid injection at the injection well promoting recovery of hydrocarbon through one or more production wells in the reservoir, wherein the injection pressure of the injection well is automatically controlled to not rise above the injection pressure limit, further wherein automatically preventing the injection pressure from rising above the injection pressure limit contains growth of the fracture within the bounding layer during the fluid injection.

* * * * *